United States Patent [19]

Loffler

[11] Patent Number: 4,903,577

[45] Date of Patent: Feb. 27, 1990

[54] ADJUSTABLE AXIAL PISTON MACHINE WITH A SWASH PLATE DESIGN

[75] Inventor: Thomas Loffler, Waldaschaff, Fed. Rep. of Germany

[73] Assignee: Linde Aktiengesellschaft, Wiesbaden, Fed. Rep. of Germany

[21] Appl. No.: 222,522

[22] Filed: Jul. 21, 1988

[51] Int. Cl.[4] ..... F01B 13/04; F01B 1/20

[52] U.S. Cl. ..... 91/488; 91/506

[58] Field of Search ..... 91/488, 506

[56] References Cited

U.S. PATENT DOCUMENTS 4,515,067 5/1985 Heyl ..... 91/506
4,543,876 10/1985 Heyl ..... 92/122

FOREIGN PATENT DOCUMENTS 134795 3/1979 German Democratic Rep. ... 91/488
1340793 12/1973 United Kingdom ..... 91/488
1355002 5/1974 United Kingdom .

*Primary Examiner*—Leonard E. Smith
*Attorney, Agent, or Firm*—Webb, Burden, Ziesenheim & Webb

[57] ABSTRACT

A system for hydrostatic pressure release of the rocker in the bearing box in an axial piston machine. The pressure-relief system includes slots in the rocker bearing box connected with axial passages through the pistons, pressure pockets in the guide shoes and passageways through the rocker. In order to render the forces in the pressure-relief system essentially constant and speed-independent, the pressure-relief devices of the rocker bearing and four individual slots, two of which are parallel to each other in the region of each of the two bearing surfaces on the rocker and which are connected to the pressure pockets in the guide shoes by the passageways through the rocker.

4 Claims, 4 Drawing Sheets

ADJUSTABLE AXIAL PISTON MACHINE WITH A SWASH PLATE DESIGN

BACKGROUND OF THE INVENTION

1. Field of the Invention

The invention relates generally to an adjustable axial piston machine having a swash plate design and more particularly to such a machine including a rotating cylindrical drum having a plurality of axial cylindrical bores equispaced from the axis of rotation and equiangularly spaced around the axis of rotation and a rotatable drive shaft to rotate the drum. A reciprocable piston is located in each axial cylindrical bore and has its lower end supported in a guide shoe. A pivotable rocker is supported in a bearing box which is concentric with the axis of the drive shaft. The guide shoes slide along a glide path on the flat sliding surface of the rocker and the rocker has two bearing surfaces in the region of the rocker bearing which are separated by the drive shaft for the cylindrical drum.

2. Description of Prior Art

In known axial piston machines of this type, pressure pockets are located in the region of the upper surface of the rocker bearing to permit a pressure release of the rocker and create small adjusting forces and permit high rotational speeds. These pressure pockets are designed as relatively complicated slot systems wherein only a single pressure pocket is always present in each of the two bearing surfaces separated by the drive shaft for the cylindrical drum. The prior art pressure pockets have different complicated shapes and consist, for example, of closed slots in the form of a figure eight or, in another case, of outwardly closed flats in the curved surface of the rocker. These pressure pockets are alternatively under high pressure or under normal operating fluid pressure on the pressure side through bore holes in the rocker during the operation of the axial piston machine. The pressure depends upon whether these boreholes, in the instantaneous operating state, empty into the pressure pockets of the guide shoes or are blocked as disclosed in United Kingdom patent No. 1,355,002.

It is possible to relieve the pressure on the pressure side of the rocker to a certain extent in known axial piston machines but the release forces always pulsate, and only one pressure pocket subject to alternating pressure is available for the loaded bearing surface. Because the frequency of the fluctuations is speed-dependent, dangerous vibrations of the machine occur in the range of certain speeds. The familiar pressure release arrangements are also relatively complicated and therefore are expensive to manufacture especially in special design variations.

SUMMARY OF THE INVENTION

The invention is a pressure-release system for the rocker in an axial piston machine having a swash plate design which permits substantially constant and speed-independent release forces in the region of the rocker bearing and at the same time has a relatively simple construction.

The invention includes a system for the release of hydrostatic pressure from pressure pockets in the form of a recess in the bottom of each guide shoe which is connected through an axial passageway in each piston with the cylindrical bore in which the piston is located. Additional pressure-release devices are located adjacent to the surface of the rocker bearing box and are periodically connected with the pressure pockets in the guide shoes through boreholes extending through the rocker as a function of the position of the guide shoes.

The pressure-release devices of the rocker bearing box consist of four individual unconnected slots or grooves positioned on arcs around the axis of the rocker. Two of the slots are parallel to each other and are located in one of the two bearing surfaces of the rocker bearing box and the other two slots are parallel to each other and are located in the other bearing surface of the rocker bearing box. The slots are simply and economically formed. The slots lie on circles around the axis of the rocker and are in the central range of the stroke path of the pistons with respect to the position of the pistons in the cylinder bores. The essential concept of the invention is that the two slots located in the region of one of the two bearing surfaces of the rocker bearing box are in communication with high pressure on the pressure side of the rocker bearing box independently of each other. Thus, a substantially constant pressure release results which is independent of the r.p.m. of the machine and which does not create undesirable vibrations of the machine.

The pressure release device of the invention is designed so that each slot in the rocker bearing box can be connected with the pressure pockets of the guide shoes through a single borehole extending obliquely through the rocker so that their ends lie one behind the other on the glide path of the guide shoes. The two boreholes associated with one of the two bearing surfaces of the rocker terminate on the glide path of the guide shoes with a spacing greater than the inside diameter of the pressure pockets in the guide shoes.

The spacing of the ends of the boreholes on the glide path of the guide shoes is selected as a function of the outside dimension of the guide shoes and the inside dimension of the pressure pockets in the guide shoes as well as the spacing of the guide shoes so that one of the two slots on the pressure side of the rocker bearing box is always under high pressure while the other is connected with the housing interior, and at the same time the transition from one state to the other takes place as rapidly as possible.

The slots forming the pressure release device in the region of the rocker bearing surface are formed in the bearing box for production and economy reasons. However, the slots can also be formed in the rocker itself if desired.

Further features and other objects and advantages of the invention will become apparent from the following description of the preferred embodiment with reference to the drawings.

DESCRIPTION OF THE PREFERRED EMBODIMENT

Figure 1:
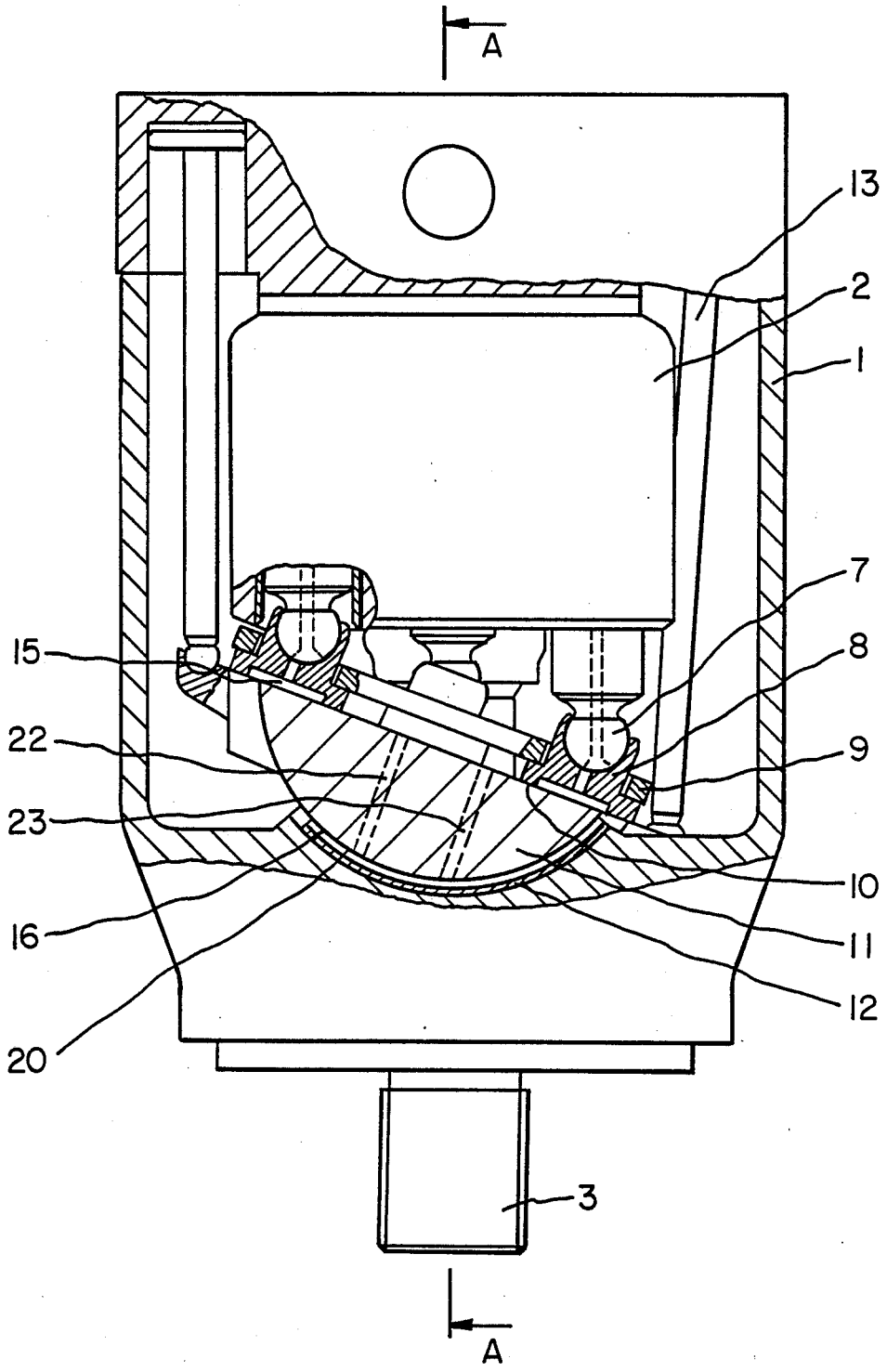
FIG. 1 is a partial vertical section through an axial piston machine according to the invention.
Figure 2:
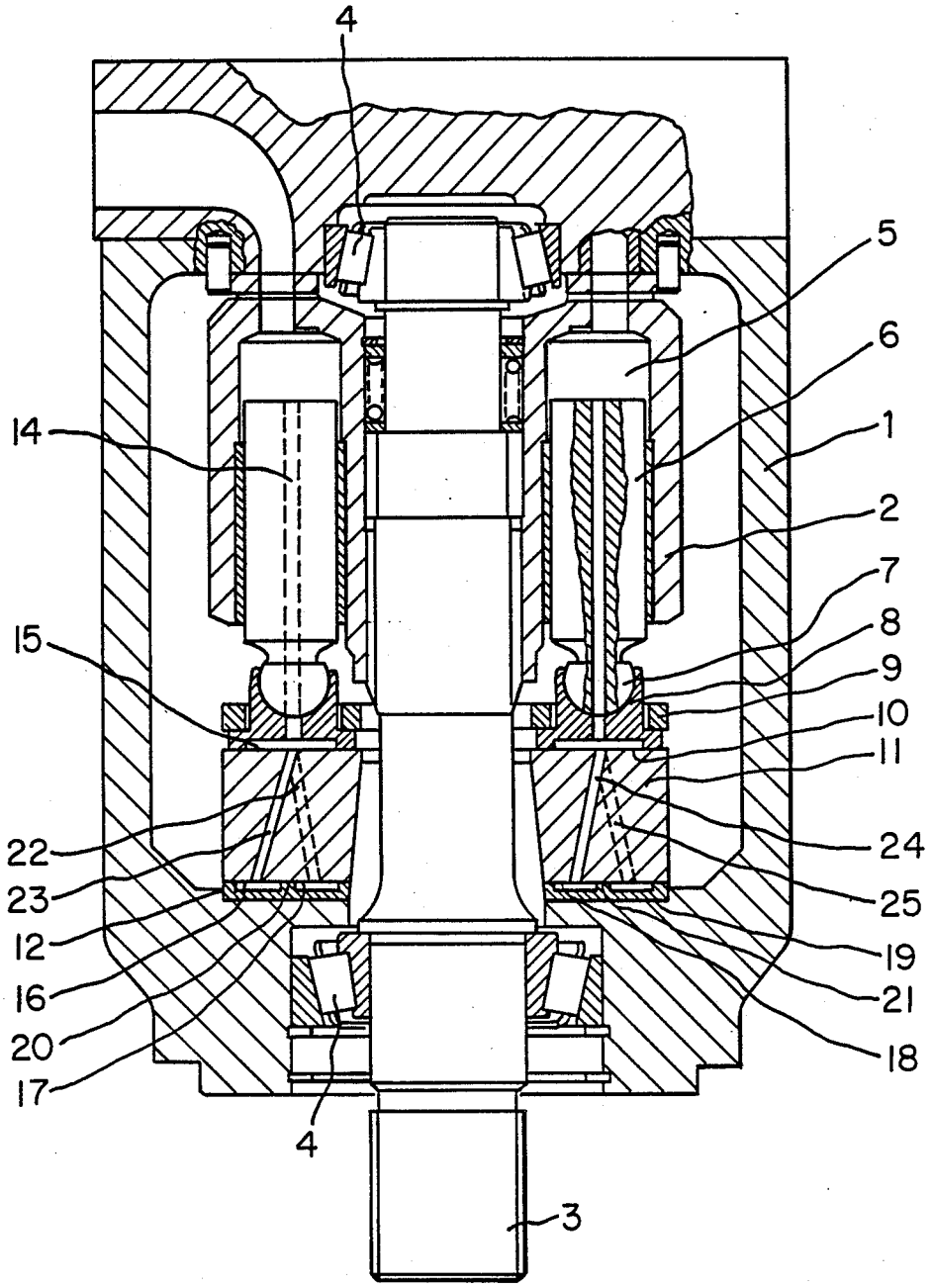
FIG. 2 is a vertical section on line A—A of FIG. 1 at an angle to the vertical.

As shown in FIGS. 1 and 2 of the drawings, the axial piston machine of the invention has an outer housing or casing 1 in which a drive shaft 3 is mounted in upper and lower roller bearings 4 supported in the housing. A cylindrical drum 2 is mounted on drive shaft 3 on bearings at the upper end of the shaft and is driven by the drive shaft through a spline connection. A plurality of cylindrical bores 5 are located in the cylindrical drum 2 in which pistons 6 reciprocate. The bores are equispaced from the drive shaft axis and are equiangularly spaced thereabout. Each piston 6 has a spherical lower end section 7 that is supported in a matching recess in a guide shoe 8. Each guide shoe 8 is pressed against the glide surface 10 on a rocker 11 by a hold-down device 9. The rocker 11 has a circular hemispherical-like vertical cross section and is tiltably supported in a bearing box 12 is mounted in housing 1 made of a known bearing material such as salt bath-nitrided perlitic spheroidal graphite iron. The rocker is cylindrical in the region of its two bearing surfaces 20 and 21 which rest on the bearing box 12 on opposite side of the drive shaft 3. As shown in FIG. 1 of the drawings, rocker 11 is tilted by adjusting rods 13 that are connected with the rocker 11 in an articulated manner.

Figure 3:
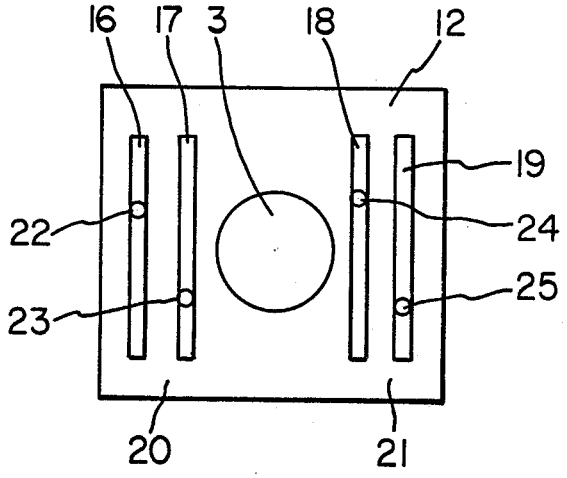
FIG. 3 is a schematic plan view of the bearing box showing the location of the slots and the lower ends of the boreholes.
Figure 4:
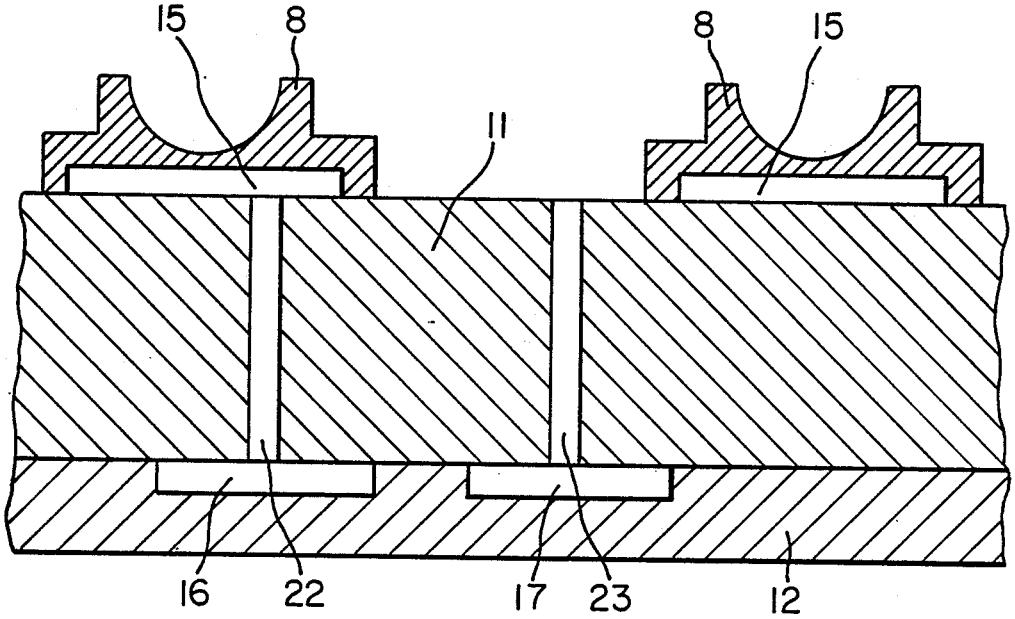
FIG. 4 is a schematic elevation through a portion of the rocker and the rocker bearing box.

The cylinder bores 5 are connected to pressure pockets 15 in the guide shoes 8 by passages 14 which extend through the pistons 6 and the guide shoes 8. Two pairs of slots 16 and 17 and 18 and 19 are formed in the upper surface of the bearing box 12, and the slots in each pair are parallel to each other on an arc around the axis of rocker 11. As can be seen in FIG. 3, which schematically shows the inside of the bearing box 12, slots 16 and 17 are located in the region of the bearing surface 20 on rocker 11 and slots 18 and 19 are located in the region of the bearing surface 21 on rocker 11. The pairs of slots are separated by the shaft 3 so that they are opposite the portions of the glide path 10 on the rocker 11 in which the pistons 6 are located in the middle of their stroke path. Slots 16, 17, 18 and 19 are respectively connected through a borehole 22, 23, 24 and 25 passing obliquely through rocker 11 from the glide path 10 on rocker 11 so that the upper ends of boreholes 22, 23, 24 and 25 lie on a circle around drive shaft 3 which is passed over by guide shoes 8 in the region of pressure pockets 15. As shown schematically in FIG. 4 of the drawings, the spacing of the upper ends of the boreholes 22, 23, 24 and 25 in a circle on the glide path is greater than the inside diameter of the pressure pockets 15 of guide shoes 8 lying in the same circle and is selected in accordance with the diameter of pressure pockets 15 and the mutual spacing of guide shoes 8.

During the operation of the axial piston machine of the invention, one of the two slots of each slot pair 16 and 17 and 18 and 19 is always connected through a borehole of the pertinent pair of boreholes 22 and 23 or 24 and 25 with a pressure pocket 15 of a guide shoe 8. The other one of the two slots of the same slot pair is connected through the other borehole of the pertinent borehole pair with the interior of the housing 1.

Figure 5:
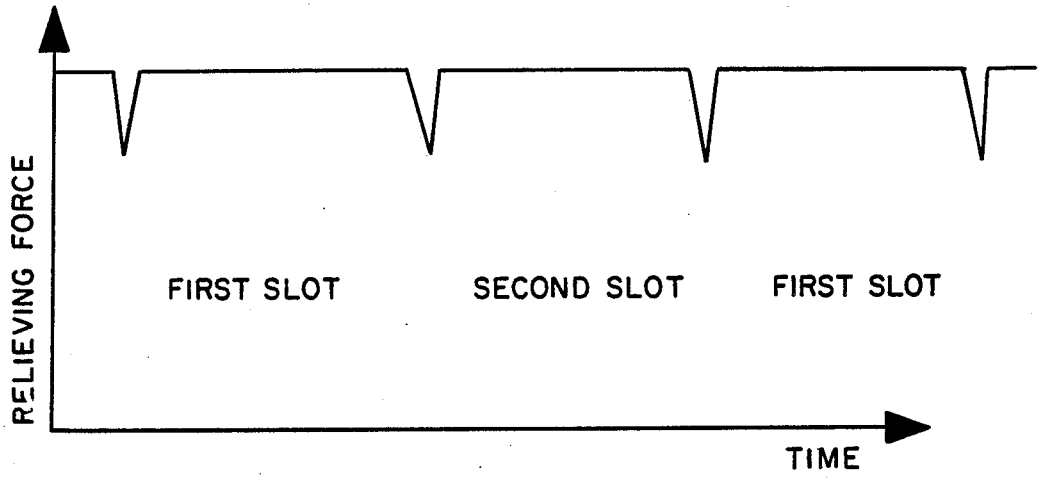
FIG. 5 is a graph showing pressure release versus time according to the invention.

During operation of the axial piston machine according to the invention, which can be either an axial piston pump or an axial piston engine in closed or open circuit, a practically constant and speed-independent pressure release results on the pressure side of the rocker, as is shown schematically in FIG. 5 of the drawings. The constancy of the relieving force plotted on the ordinate is interrupted only by minimal drops during passage of the pressure loading from one of the two slots of the corresponding slot pair to the other and those drops are not noticeable during operation of the machine.

Having described the invention with the particularity required by the Patent Laws, what is claimed and desired to be protected by Letters Patent is the subject matter set forth in the following claims.

I claim:

1. A swash plate design adjustable axial piston machine having a housing, a rotary drive shaft and a revolving cylindrical drum mounted on said drive shaft, said drum having a plurality of cylindrical bores equispaced from the axis of said drum and equiangularly spaced about the axis of said drum, a reciprocable piston having an elongated substantially axial passage therethrough located in each of said cylindrical bores and having an upper end and a lower end, said lower end of each of said pistons supported in a guide shoe, a bearing box located in said housing concentric with said drive shaft, a tiltable rocker supported in said bearing box within said housing, said rocker having a flat sliding surface forming a glide path for said guide shoes to slide along a circular path, said rocker having two bearing surfaces separated by said drive shaft, said machine including means for hydrostatic pressure release, said means including a pressure pocket in the form of a recess in each of said guide shoes, each of said pressure pockets connected through the passage in the companion piston with the interior of the companion cylindrical bore, passageways in said rocker and four individual unconnected slots lying on circular arcs around the axis of said rocker, said slots being arranged in two pairs and the two slots in each of said pairs being parallel to each other in one of said two bearing surfaces for periodic connection with said pressure pockets in said guide shoes through said passageways in said rocker as a function of the instantaneous position of said guide shoes on said sliding surface.

2. An axial piston machine as set forth in claim 1, wherein each said individual slots is connected through a single passageway through said rocker with a pressure pocket in a guide shoe and each of said passageways pass through said rocker obliquely so that the ends of said passageways lie one behind the other on the guide path for said guide shoes so that the two passageways assigned to each of said two bearing surfaces of said rocker terminate on the guide path of said guide shoes at a spacing from each other that is greater than the inside diameter of said pressure pockets in said guide shoes on said rocker.

3. An axial piston machine as set forth in claim 1, wherein said slots are formed in said rocker bearing box.

4. An axial piston machine as set forth in claim 2, wherein said slots are formed in said rocker bearing box.

* * * * *

UNITED STATES PATENT AND TRADEMARK OFFICE

CERTIFICATE OF CORRECTION

PATENT NO. : 4,903,577

DATED : February 27, 1990

INVENTOR(S) : Thomas Loffler

It is certified that error appears in the above-identified patent and that said Letters Patent is hereby corrected as shown below:

On the title page:
After the filing date information insert --Foreign Application Priority Data
Jul. 22, 1987 [De] Fed. Rep. of Germany . . . 3724285--.

Claim 2 Line 48 Column 4 after "each" insert --of--.

Claim 2 Line 55 Column 4 "guide" (first occurrence) should read --glide--.

Signed and Sealed this

Nineteenth Day of March, 1991

*Attest:*

HARRY F. MANBECK, JR.

*Attesting Officer*

*Commissioner of Patents and Trademarks*